US006363824B1

(12) United States Patent
Granger

(10) Patent No.: US 6,363,824 B1
(45) Date of Patent: Apr. 2, 2002

(54) PAPER-WIPE DISPENSING MACHINE

(76) Inventor: Maurice Granger, 17 Rue Marcel Pagnol, 42270 Saint Priest en Jarez (FR)

( * ) Notice: Subject to any disclaimer, the term of this patent is extended or adjusted under 35 U.S.C. 154(b) by 0 days.

(21) Appl. No.: 09/576,019

(22) Filed: May 23, 2000

Related U.S. Application Data

(63) Continuation of application No. PCT/FR98/02394, filed on Nov. 10, 1998.

(30) Foreign Application Priority Data

Dec. 1, 1997 (FR) ..... 97 15356

(51) Int. Cl.[7] ..... A47K 10/36; B26D 5/38; B65H 20/02

(52) U.S. Cl. ..... 83/334; 83/337; 83/649; 83/949; 25/106; 242/560; 242/564.4; 242/564.5

(58) Field of Search ..... 83/649, 298, 334, 83/335, 337, 937, 949; 225/39, 51, 106; 242/560, 564.4, 564.5

(56) References Cited

U.S. PATENT DOCUMENTS 3,297,269 A * 1/1967 McGrew ..... 242/564.4
4,165,138 A * 8/1979 Hedge et al. ..... 242/560
4,213,363 A 7/1980 Granger
4,635,837 A * 1/1987 Granger ..... 83/337
5,048,386 A * 9/1991 DeLuca et al. ..... 83/649
5,078,033 A * 1/1992 Formon ..... 83/649
5,441,189 A * 8/1995 Formon et al. ..... 83/337
5,630,526 A * 5/1997 Moody ..... 225/106
5,836,862 A * 11/1998 Granger ..... 493/459
5,868,343 A * 2/1999 Granger ..... 242/564.4
5,915,645 A * 6/1999 Granger ..... 242/560
5,937,718 A * 8/1999 Granger ..... 83/649
5,979,284 A * 11/1999 Granger ..... 83/649
6,006,642 A * 12/1999 Granger ..... 83/649
6,027,002 A * 2/2000 Granger ..... 83/337
6,032,898 A * 3/2000 LaCount et al. ..... 242/564.4
6,079,305 A * 6/2000 Bloch et al. ..... 83/649
6,092,451 A * 7/2000 Granger ..... 83/337
6,112,631 A * 9/2000 VanAlstine ..... 83/649
6,196,102 B1 * 3/2001 Granger ..... 83/649

FOREIGN PATENT DOCUMENTS

FR 2723303 2/1996

* cited by examiner

*Primary Examiner*—Kenneth E. Peterson
*Assistant Examiner*—Stephen Choi
(74) *Attorney, Agent, or Firm*—Wall Marjama & Bilinski LLP

(57) ABSTRACT

A wiping paper dispenser for hand towels and toilet paper includes a housing having a gantry which tilts relative to the housing and receives an idle roller in contact with a contained reel of paper material for ensuring a dual function of pressing and braking the reel and preventing curling. The gantry is linked to a hinged flap at the front base of the housing countering a spring, the flap being adjustable in relation to a rotatable drum. The drum and the idle roller are rotatably driven in response to the user's pull on an extending paper strip from the reel of material.

10 Claims, 6 Drawing Sheets

PAPER-WIPE DISPENSING MACHINE

CROSS REFERENCE TO RELATED APPLICATION

This is a continuation application of International Application PCT/FR98/02394, with an international filing date of Nov. 10, 1998.

BACKGROUND OF THE INVENTION

The invention relates to the technical field of dispensing machines for paper wipes of the cellulose wadding type for applications such as hand wipes, toilet paper, wiping and cleaning in general.

The Applicant has already developed many machines of this type for the above-mentioned applications. These machines are of the type comprising a housing with a protective cover, said housing being designed to accommodate and enclose a drum designed to position and operate a cutting device. A pressure component pushes against the drum and the reel of wound material is mounted on a reel holder which makes it possible to dispense the strip of material towards the drum so that the strip can be cut when the user manually pulls the strip that emerges from the housing.

SUMMARY OF THE INVENTION

Machines of the above-mentioned type are already in use and, generally speaking, meet users'needs satisfactorily. However, certain types of thick wound papers still pose problems because current machines do not operate satisfactorily in terms of dispensing and cutting the paper to size with sufficient reliability.

Another drawback of known paper-wipe dispensing machines is the fact that it is difficult to vary the sizes of the cut strips of paper unless a format selecting device is built into the drum, a process which is complicated and expensive.

Dispensing machines of the known type also make it possible, in certain cases, to move a reel of material that is nearly exhausted towards the back and rear of the machine, thereby freeing the reel holder in order to load a new reel. In this case the machine allows finishing of the first reel until it is completely used up by employing a special mechanism, referred to hereinafter as a "finishing roller" and automatic presentation of the end of the second reel to the cutting device. Nevertheless, there is still the drawback that it is difficult to access the bottom of the housing without performing manipulations that are relatively impractical.

All these drawbacks led the Applicant to research and design a new paper-wipe dispensing machine that overcomes the above-mentioned drawbacks.

Patent FR 2723303 discloses a dispensing machine which conforms with the preamble to claims 1 and 2.

The first object was therefore to design a machine capable of dispensing and cutting thick unfolded cellulose wadding paper wipes, wound on reels.

Another object sought after according to the invention was to produce a dispensing machine of standardised design that could be used to dispense cut strips of paper of variable size without the need for complex manipulations.

Another object sought after was to devise a dispensing machine that made it possible to fit the finishing roller easily and accessibly after loading a new reel of wipe material.

To achieve this, the object of the invention according to a first variant is a paper-wipe dispensing machine for hand wipe, toilet paper, wiping and cleaning applications in general, the machine being of the type comprising a housing with a hinged protective cover, said housing being devised to allow positioning of a drum that includes a cutting device with an associated cutting blade installed inside the housing and operating as a function of rotation of the drum, a reel holder for a reel of unfolded wound material, means of guiding and directing the paper so that the paper can be removed from the machine, means in the form of rack-and-pinion on the drum and on the facing lateral side of the housing in order to start and eject the cutting blade, characterised in that it comprises a support means consisting of a gantry that swings relative to the housing and accommodates a pinch roller that is in contact with the reel of material an d fulfils the dual function of pushing against and braking the reel and preventing any loops, and in that said gantry is connected to a flap hinged on the front base of the housing by elastic return means, said flap being tiltable depending on the diameter of the drum, and in that a drive means is associated with the drum and the pinch roller and fulfils the dual function of pushing against and braking the reel and preventing any loops in opposition to the paper when it is tensioned as it is pulled by the user.

The second object of the invention according to a second variant is a paper-wipe dispensing machine for hand wipe, toilet paper, wiping and cleaning applications in general, the machine being of the type comprising a housing with a hinged protective cover, said housing being devised to allow positioning of a drum that includes a cutting device with an associated cutting blade installed inside the housing and operating as a function of rotation of the drum, a reel holder for a reel of unfolded wound material, means of guiding and directing the paper so that the paper can be removed from the machine, means in the form of rack-and-pinion on the drum and on the facing lateral side of the housing in order to start and eject the cutting blade, characterised in that it comprises a support means consisting of a gantry that swings relative to the housing and accommodates a pinch roller that is in contact with the reel of material and fulfils the dual function of pushing and braking the reel and preventing any loops, and in that said gantry is connected to a flap hinged on the housing by elastic return means, said flap being tiltable depending on the diameter of the drum of the machine, and in that a drive means is associated with the drum and the pinch roller and fulfils the dual function of pushing against and braking the reel and preventing any loops in opposition to the paper when it is tensioned as it is pulled by the user, and in that the flap has lateral legs attached to the sides of the housing between which there is a roll placed away from the drum, said roller fulfilling a deflection function with the strip of paper being braked by the pinch roller alone.

These characteristics and others will be apparent from the following description.

In order that the object of the illustrated invention may be more readily understood, in a non-exhaustive manner, reference is made to the following drawings in which:

Figure 1:
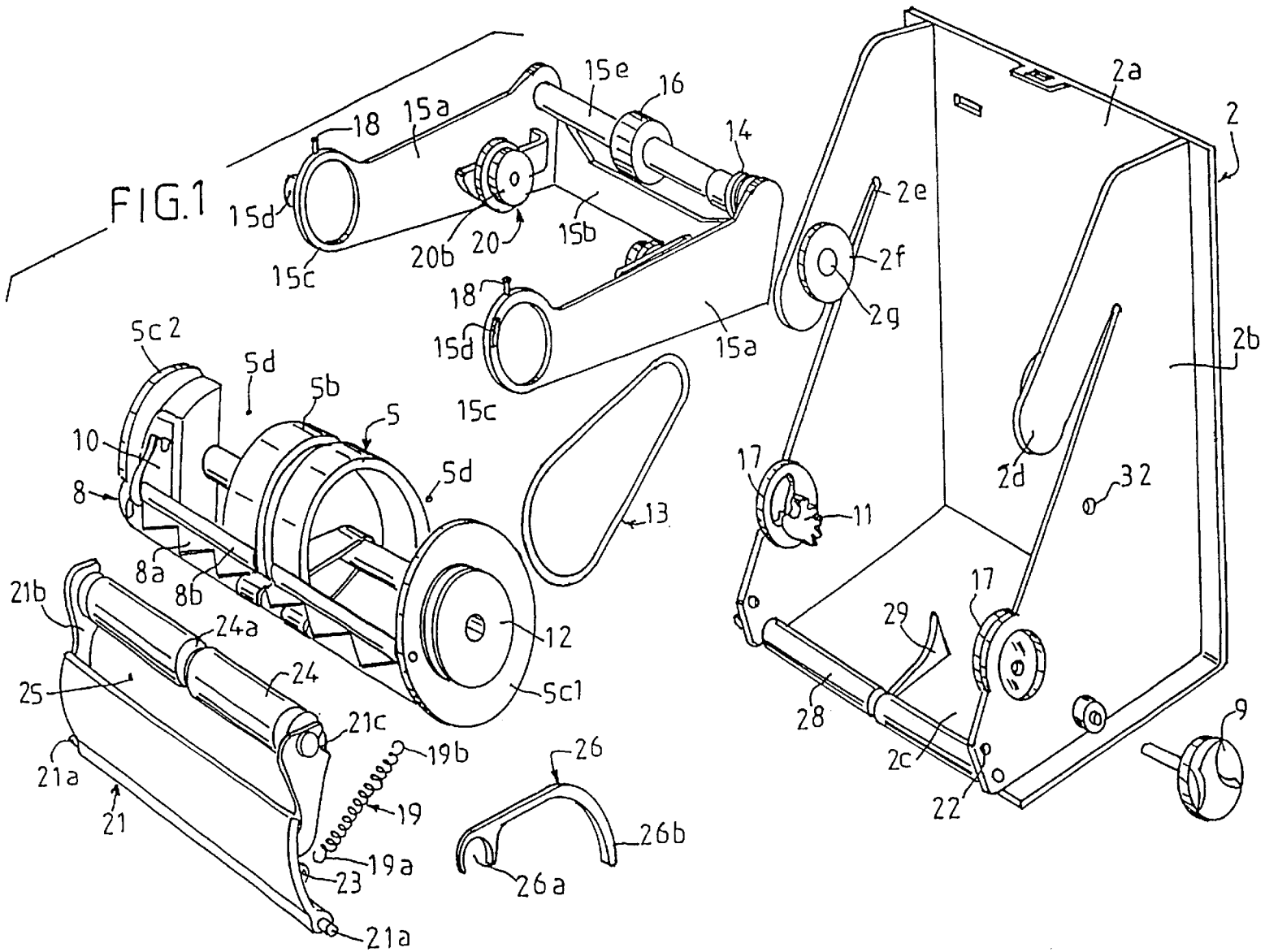
FIG. 1 is a perspective view of the paper-wipe dispensing machine before assembly of its components.
Figure 2:
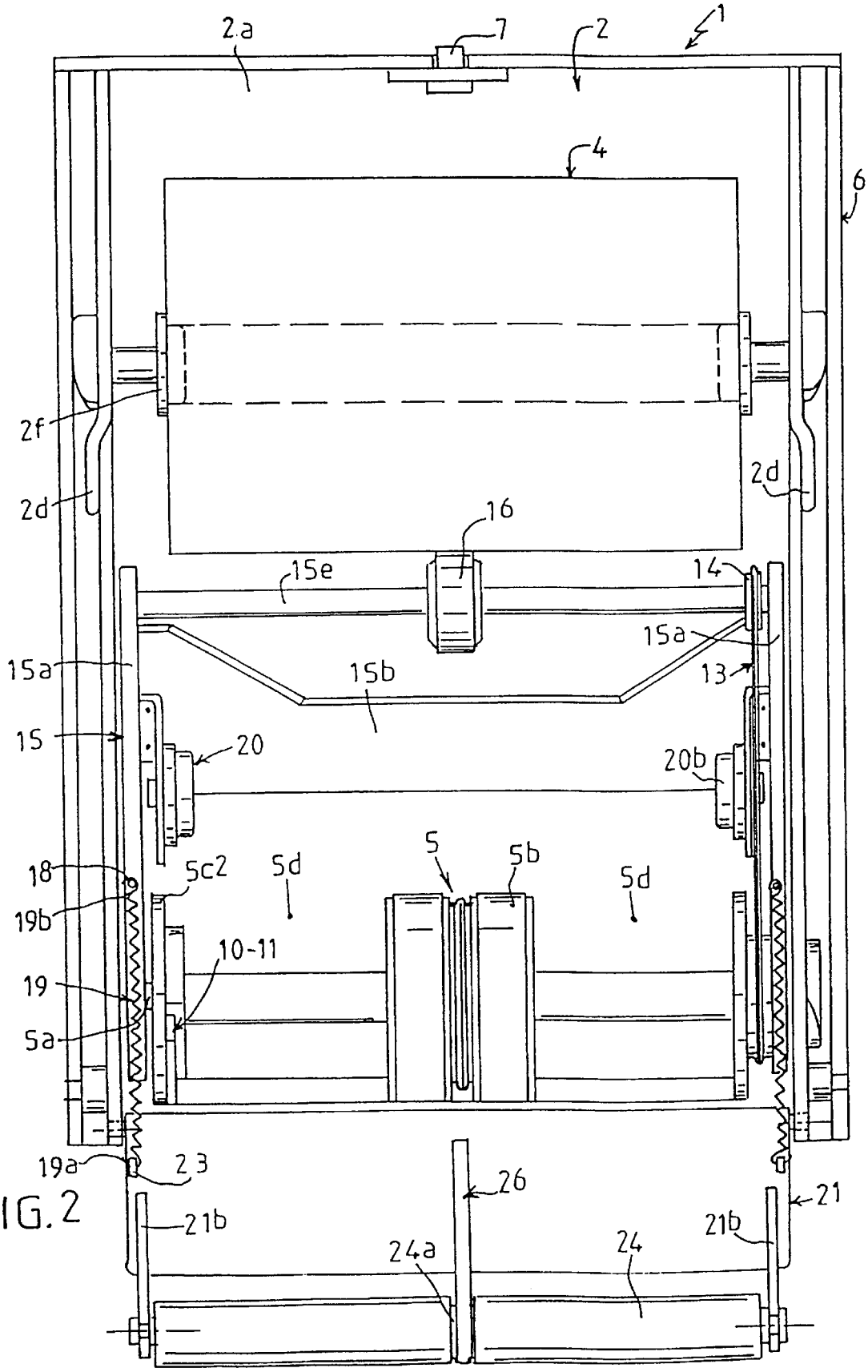
FIG. 2 is a front view of the machine according to FIG. 1 before assembly of its components with the cover removed and the lower flap tilted in order to make the drawings easier to understand.

In order that the object of the invention may be more readily understood, it is described below, in a non-exhaustive manner, reference being made to the drawings.

DESCRIPTION OF THE INVENTION

The machine for dispensing paper wipes, paper hand wipes and toilet paper is referred to in its entirety as (1). It comprises, in a known manner, a housing (2) with a bottom rear wall (2*a*), two lateral sides (2*b*) and a base wall (2*c*). Said walls and sides are designed to make it possible to install the reel holder for the reel of wound material (4), the drum (5) for dispensing and cutting the paper to a predetermined size. The housing is a one-piece unit made of rigid plastic and can accommodate a cover (6) that is hinged to the housing and protects the various mechanisms and components and has means of locking it to the housing of known key (7) type.

The upper part of the lateral sides of the housing (2) is designed with two protruding tongues (2*d*) that are separated from the central part of said sides by a slit (2*e*) or cut-out making them relatively elastic so that they can be spread apart in order to install the reel (4) of wipe material. Said tongues (2*d*) may be designed with disks (2*f*) making it possible to install the tube around which the reel of material is mounted and wound, said disks (2*f*) having an opening (2*g*) through which pointed end-fittings inserted into the above-mentioned tube can be inserted and passed. In the lower part of the machine, the sides (2*b*) are devised to allow positioning and rotation of drum (5) which accommodates cutting device (8) with blade (8*a*). The drum may be of the same type as those described in the Applicant's various previous patents, especially Patent FR 2723303. The shaft ends (5*a*) of the cylinder-shaped drum (5) are mounted on the lateral sides (2*b*) of the housing and an operating knob (9) is associated with one of the ends of the drum in order to rotate it with a view to loading the machine. The cutting device with a blade is described in previous French Patent No. 2723932.

The blade holder (8*b*) is moved by means of a rack-and-pinion mechanism (10–11) located on the drum (10) and on the opposite facing side of the housing (11), thus allowing ejection of the blade and instant cutting of the pulled strip of paper. Drum (5) is designed, for instance, with a configuration described in FR Patent No. 2723303 and its middle part (5*b*) has an area to support the strip of pulled paper. Said area includes a gripping surface fitted in any appropriate way. The drum advantageously has, between its end shields (5*c*1–5*c*2) forming a disk and its middle part (5*b*), wide cut-aways (5*d*) over part of its periphery, the rest of its periphery being solid in order to allow the paper to be pulled at an angle if applicable. Opposite the rack (10) located on one side of the drum, there is a pulley (12) which is integrally moulded as part of end shield (5*c*1) and is capable of accommodating a belt (13) which is itself connected to another fast pulley (14) located on a hinged gantry (15), the function of the latter and its characteristics being described later on in this description. As far as said drum is concerned, the latter may be designed as described or be solid without any cut-away.

Having succinctly stated the main features of the machine which are of known types, apart from the gantry, the distinctive features of the invention will now be referred to.

According to one first original feature, the dispensing machine comprises a means of support consisting of a swinging gantry (15) devised to accommodate a pinch roller (16) which is capable of being in contact with reel (4) in order to contribute towards tensioning the paper, by exerting a pressure and braking force on the reel in opposition to the pulled paper and in order to facilitate and allow cutting of the paper by the cutting device built into the drum.

Said gantry (15) has a U-shaped configuration with two arms (15*a*) that are parallel to each other and also parallel to the lateral sides (2*b*) of the housing, these arms being joined by a spacer plate (15*b*) and the support shaft (15*e*) of the pinch roller (16). The free ends (15*c*) of said arms (15*a*) have a ring-shaped configuration that fits and surrounds the cylindrical bearing surfaces (17) formed on the sides (2*b*) of the housing around the areas where the shaft ends (5*a*) of drum (5) are positioned. Gantry (15) can therefore swing relative to said drum (5). On the rings (15*c*) at the end of the arms, there are fastening points (18) that are used to attach return springs (19) which are described later on. On said rings (15*c*) there are protrusions (15*d*) which form limit stops relative to the sides of the housing. The support shaft (15*e*) is rotatably mounted on the gantry between said arms and its middle part accommodates fixed pinch roller (16) which can push against the reel of material (4) located on the reel holder. One of the ends of said support shaft (15*e*) is designed to accommodate a fast pulley (14) situated in the same plane as the matching pulley (12) formed on the drum and the above-mentioned belt (13) links them. Rotation of the drum when the strip of paper is pulled by hand causes rotation of the support shaft of the pinch roller and hence the roller itself.

Furthermore, the insides of the arms (15*a*) of gantry (15) described earlier have devices (20) in the shape of cradles (20*a*) or end fittings (20*b*) that are used to install the finishing roller, thereby freeing the upper reel holder so that a new reel of material can be loaded.

Also and according to another important feature of the invention, the dispensing machine has, on its front part, a hinged flap (21), the lower ends of which have studs (21*a*) that fit onto the lower front part of the housing of the machine, thanks to appropriate openings (22). This flap extends over the entire width of the housing and its inside surface has fastening points (23) for attaching two return springs (19) by one of their ends (19*a*), whereas their other ends (19*b*) are attached to fastening points (18) on the rings of the gantry.

Figure 3:
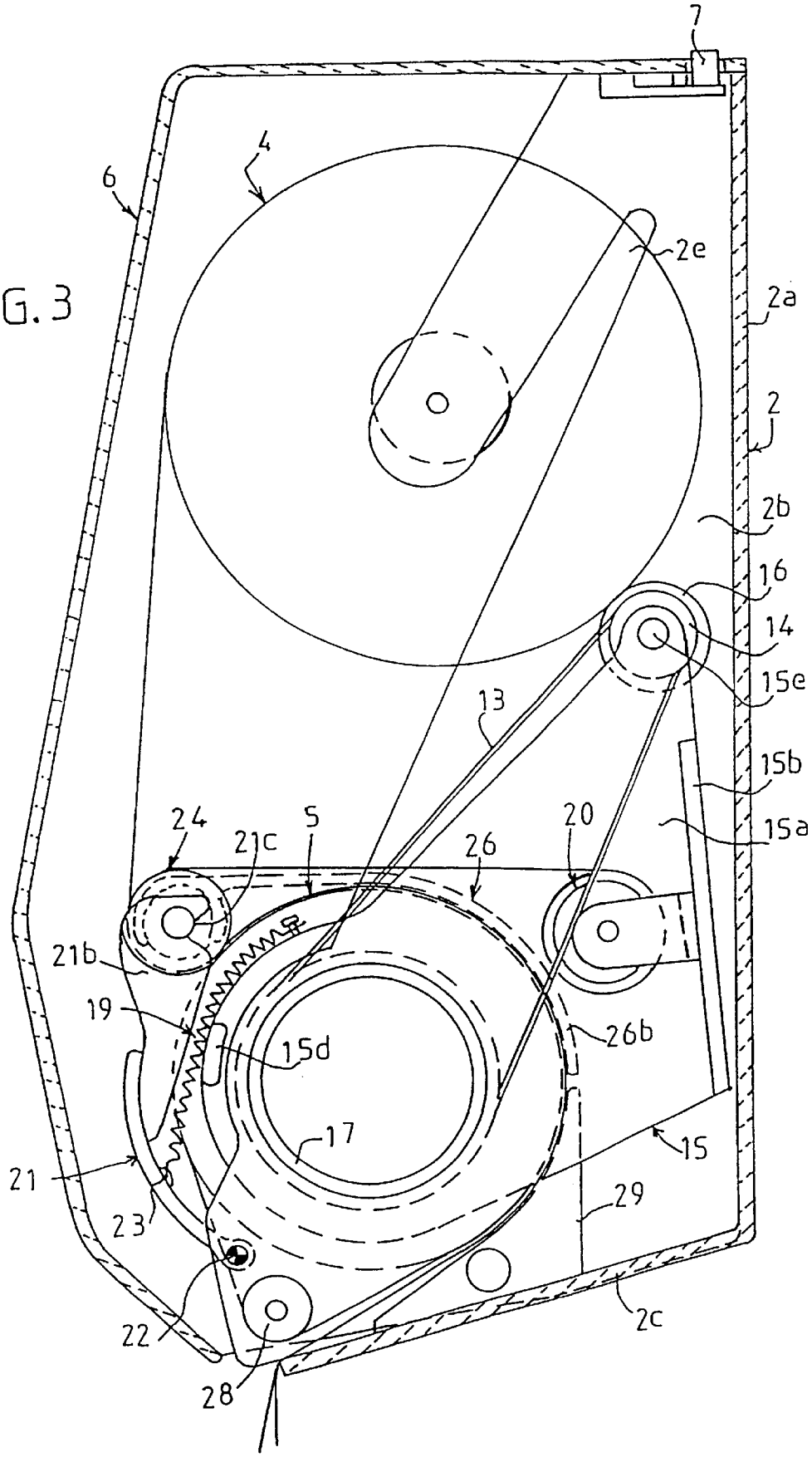
FIG. 3 is a side view of the dispensing machine according to FIG. 2 showing it in its operational state.

Said flap (21) is therefore normally pulled inwards into the housing through the action of return springs (19). The upper part of the flap has legs (21*b*), the ends of which form hooks (21*c*), making it possible to fit and clip fasten a pressure roller (24) which is capable of moving towards the drum and touching it. Because of the way it is mounted, said pressure roller (24) is held slightly away from said flap and leaves a window (25) through which the strip of paper can pass and be wound around the drum. The pressure roller (24)

also acts as a deflection idler. The middle part of pressure roller (24) has a gap (24*a*) making it possible to fit a paper guide (26). The latter has a shape (26*a*) that clips onto said pressure roller and its front end (26*b*) has a gooseneck shape so that it fits around the middle part of the drum in order to guide the paper as shown in FIG. 3.

The lower part of the housing also accommodates, in a known manner, a safety roller (28) that prevents fingers being inserted into the machine whilst nevertheless allowing the paper to emerge without obstructing it.

Furthermore, a section (29) is moulded onto the base wall of the housing opposite the middle part of the drum and acts as an extension of paper guide (26) in order to allow the paper to be transported and ejected out of the machine.

Figure 5:
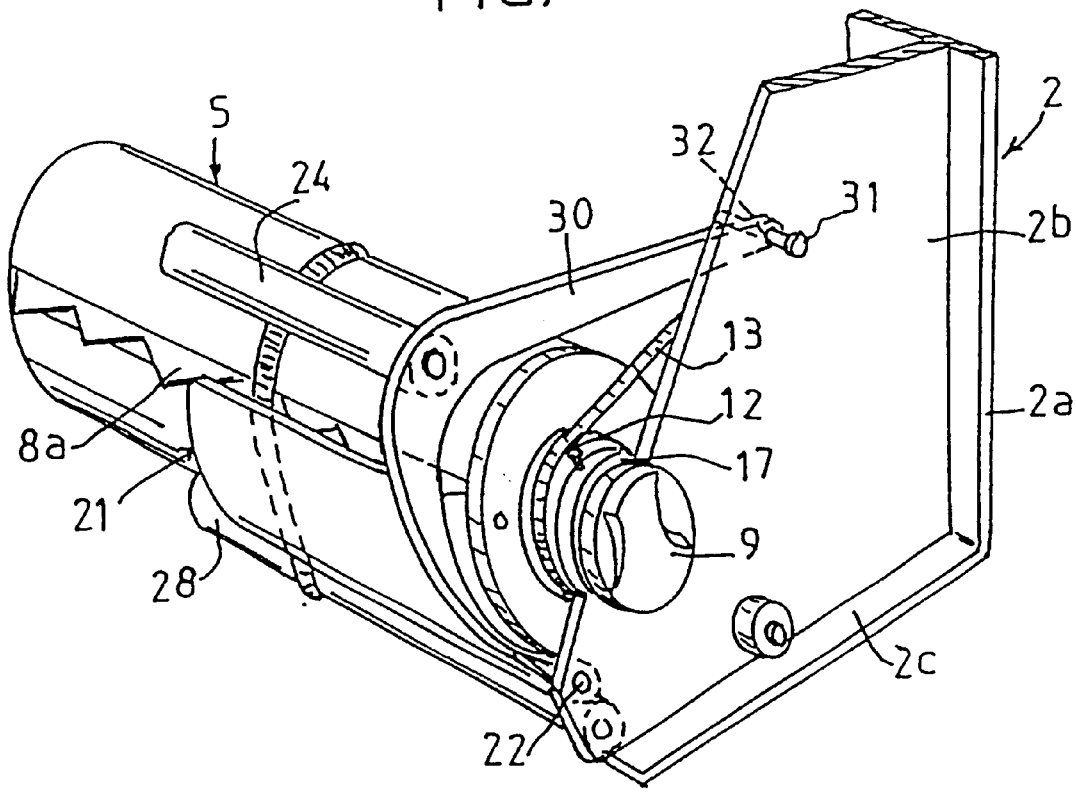
FIG. 5 is a partial perspective view of the lower part of the dispensing machine in which the tiltable flap is mounted so that it does not contact the drum.

As stated previously, the flap (21) that supports pressure roller (24) is hinged so that it swivels in opposition to return springs (19) and relative to gantry (15). Said flap (21) can therefore advantageously be moved out of the way so that the drum can be installed or changed. FIG. 5 shows a drum of larger diameter that can be used to dispense longer-sized pieces of paper. The flap remains flexibly pushed against the drum in a position that is slightly more spread apart than previously. The design of the dispensing machine is therefore advantageous in that it allows, thanks to the elastic return link between gantry (15) and flap (21), the pinch roller to exert a constant pressure against the reel of material and allows said flap to be positioned appropriately for any drum diameter. Loading the reel of material causes gantry (15) to swivel downwards towards the bottom rear of the housing and tensions the springs (19). Gradual paying out of the reel causes the gantry to rise gradually and pinch roller (16) continues to push constantly against the reel, thus preventing the formation of any loop and also braking the paper so that it can be cut. In this configuration, the strip of dispensed paper is braked by both the force exerted by roller (16) on the reel and that exerted by the pressure roller against the drum, thereby controlling tensioning of the paper and ensuring that the paper is cut properly and preventing the formation of any loops.

Figure 6:
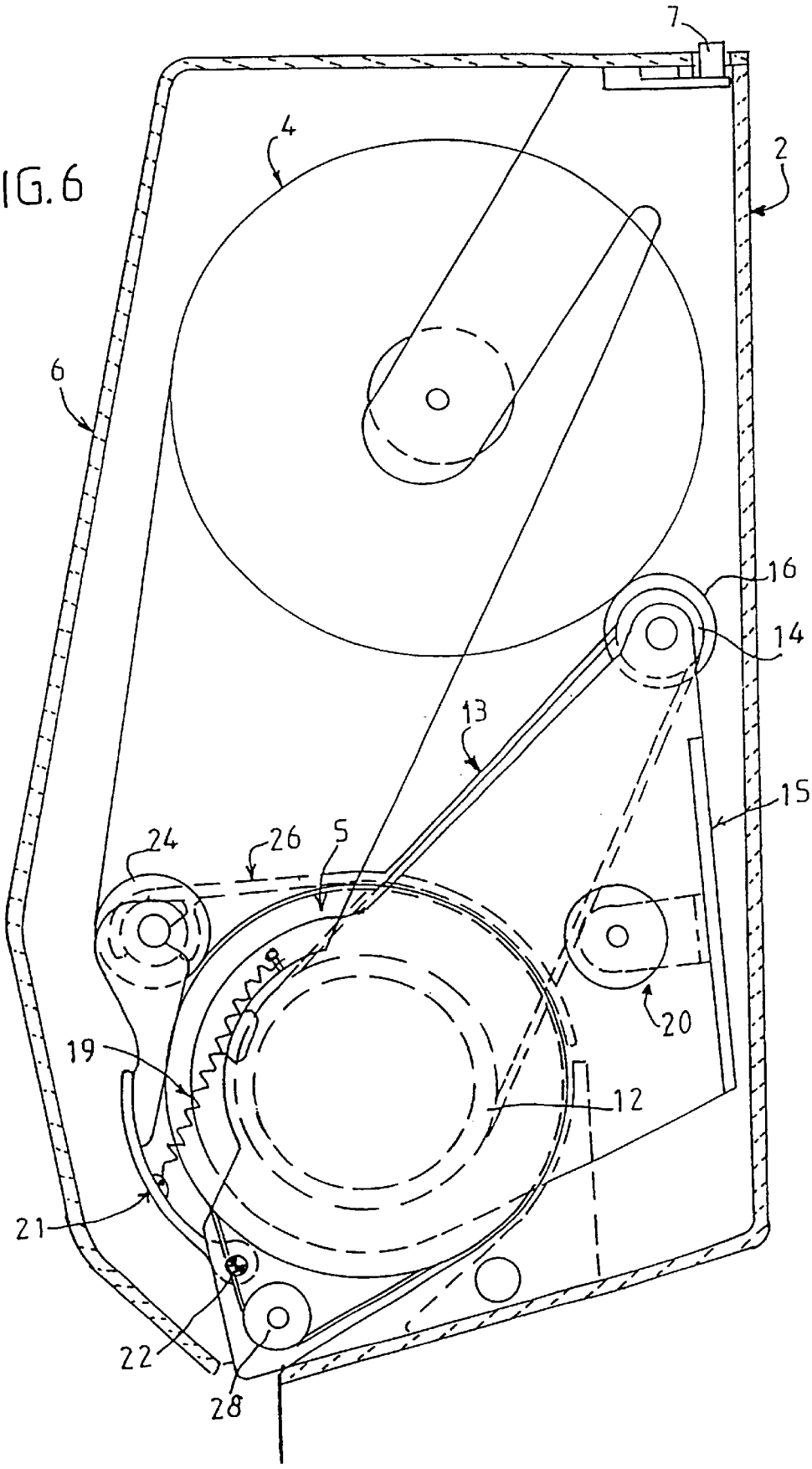
FIG. 6 is a side view of the dispensing machine according to the invention and shows a drum and associated cutting device having a diameter in excess of that shown in FIG. 1 which can be used to dispense a larger sized piece of paper.
Figure 7:
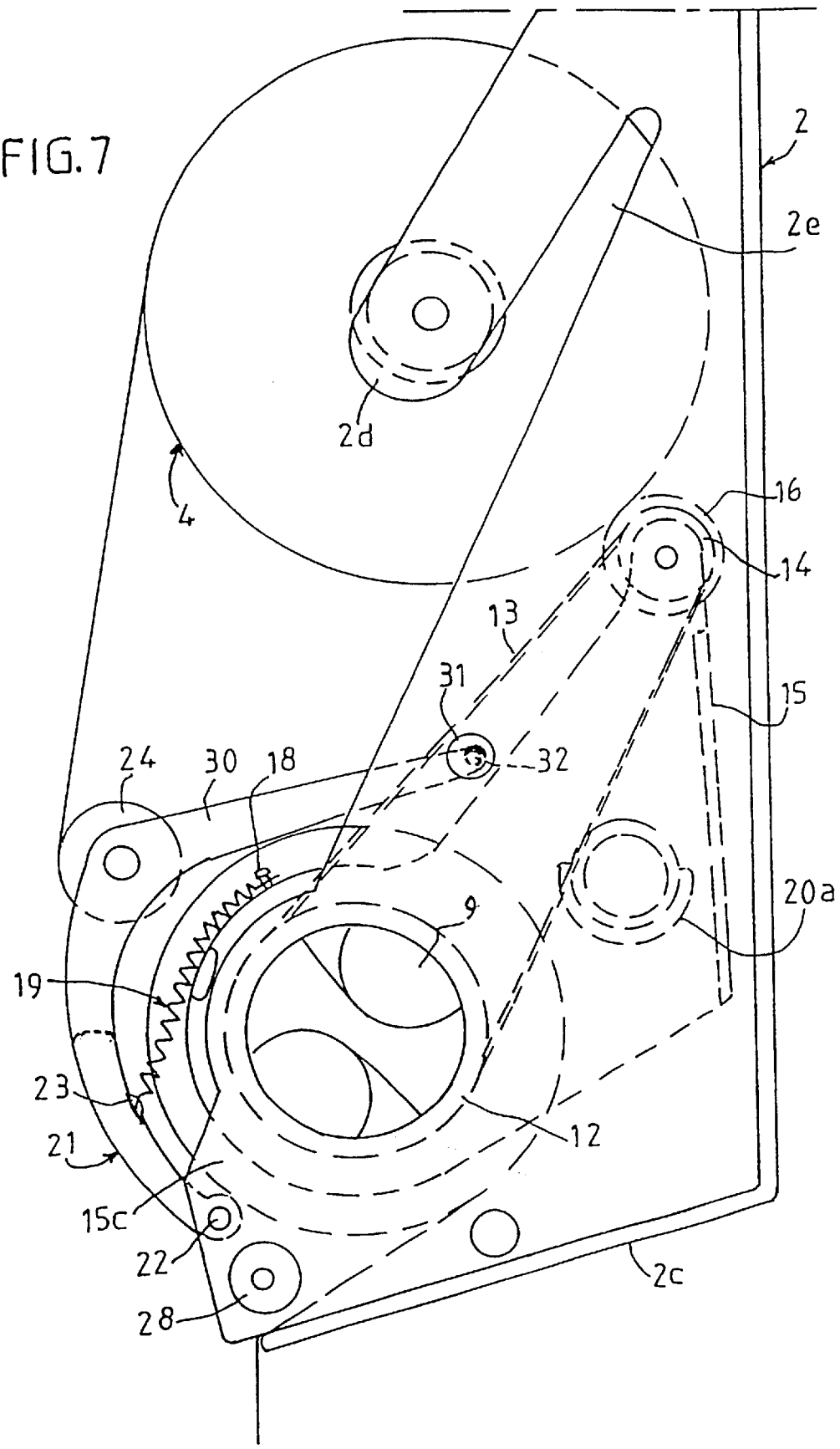
FIG. 7 is a side view of an alternative dispensing machine embodiment in which the flap and deflection idler are in a fixed position and do not contact the drum.

It is also possible, as shown in FIGS. 5 to 7, to locate flap (21) in a fixed position relative to the housing of the machine. In this case, the flap has extended lateral legs (30) which fix onto the lateral sides of the housing by means of pins (31) through appropriate openings (32). In this way flap (21) is held in a position such that pressure roller (24) which is associated with it is moved away from the drum and is used only to deflect the strip. In this case the strip of paper is braked exclusively by the pinch roller pushing against the reel.

The advantages of the invention are clearly apparent, the following points in particular being emphasised:

The fact that the pinch roller always pushes against the reel ensures controlled pay-out of the paper by preventing the formation of loops and fulfils a secondary paper-brake function.

The straightforward replacement of the drum depending on the size of paper required is stressed.

The positioning of the finishing roller on the gantry.

Furthermore, all the components of the dispensing machine are assembled by clip fastening onto the housing and no tool is required to assemble or disassemble it.

Without extending beyond the scope of the invention, the drum that accommodates the cutting device can be designed in any appropriate way, depending on requirements.

Figure 4:
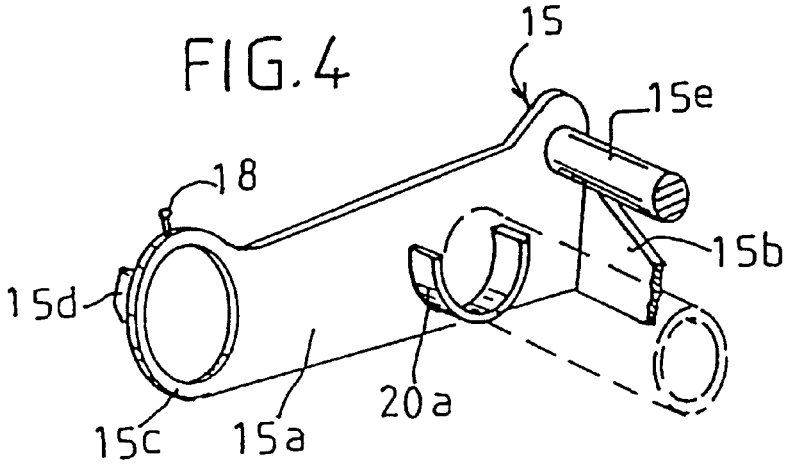
FIG. 4 is a partial view showing the layout of the reel holder to accommodate the finishing roller.

The shapes on the gantry that make it possible to accommodate the finishing roller can be produced in the shape of cradles, as shown in FIG. 4 for example, or be produced in the shape of end fittings that spread apart laterally due to the elasticity of their mounting in opposition to the swinging arms. The dispensing machine described meets the observed needs in a highly satisfactory manner, especially the dispensing and cutting of thick paper irrespective of the direction in which the strip of paper is pulled.

What is claimed is:

1. A paper dispensing machine comprising:

a housing having an interior and a hinged protective cover;

a drum rotatably supported within the interior of said housing;

a cutting device having a cutting blade, said cutting device being installed inside the housing, said cutting blade being operatively movable between a cutting position and a non-cutting position based upon rotation of said drum;

a reel holder disposed within said housing for supporting a reel of unfolded wound paper material;

means for guiding and directing a band of paper from said reel such that a paper strip can be removed from the machine;

rack-and-pinion means provided on the drum and on a facing lateral side of the housing for starting and ejecting the cutting blade;

support means for pushing against and braking the reel and preventing looping in the paper band, said support means including a gantry which supports said reel holder and swings relative to the housing, a pinch roller supported on said gantry that is in contact with the supported reel of material, and a hinged flap disposed on a front base of the housing, said hinged flap being connected to said gantry by elastic return means, said flap being tiltable relative to said front base depending on the size of the drum contained within the machine; and drum drive means associated with said drum and said pinch roller for pushing against and braking the reel and for preventing any loops in opposition to the paper when the band of paper is tensioned as the band of paper is pulled by the user.

2. Dispensing machine as claimed in claim 1, wherein said gantry has a U-shaped configuration including two arms that are parallel to each other and parallel to lateral sides of the housing, the ends of each arm being capable of fitting and surrounding cylindrical bearing surfaces formed on opposing lateral sides of said housing, said arms being joined by a spacer and a support shaft that supports said pinch roller and in which support means further includes a fast pulley located on the end of the support shaft of the pinch roller for accommodating said drum drive means.

3. Dispensing machine as claimed in claim 2, wherein the support shaft of said pinch roller is rotatably mounted to the arms of the gantry.

4. Dispensing machine as claimed in claim 2, wherein the ends of the arms of said gantry are substantially ring-shaped in order to fit and surround said cylindrical bearing surfaces formed on the lateral sides of the housing, said ring-shaped ends each having fastening points for receiving one end of said elastic return means.

5. Dispensing machine as claimed in claim 4, wherein each of said ends of the arms of said gantry include protrusions forming a limit stop relative to the lateral sides of the housing.

6. Dispensing machine as claimed in claim 2, including a drum pulley disposed near one end of said drum, said drum pulley being located in the same plane as said fast pulley located on the gantry, said device further including a belt interconnecting said drum pulley and said fast pulley that transmits rotation of the drum to the support shaft of pinch roller.

7. Dispensing machine as claimed in claim 2, wherein the insides of each arm of the gantry include means for receiving a finishing roller, thereby freeing the reel holder so that a new reel of material can be loaded.

8. Dispensing machine as claimed in claim 1, wherein said hinged flap includes lower ends having fingers that fit into openings on the front base of the housing of the machine, an inside face of the hinged flap accommodating anchoring points for said elastic return means, wherein an upper part of said flap includes legs for positioning a pressure roller which deflects the strip of paper.

9. Dispensing machine as claimed in claim 8, wherein said hinged flap is swivelably mounted relative to the housing, said pressure roller pushing against and braking the strip of paper on the drum, thereby contributing towards tensioning said strip of paper together with the matching pressure area of said pinch roller on the reel.

10. Dispensing machine as claimed in claim 8, wherein said pressure roller includes a middle part having a gap sized to receive a paper guide, said paper guide having a shape that clips onto the pressure roller wherein a front end of said paper guide has a gooseneck shape that fits around a middle part of the drum.

* * * * *